US005267849A

United States Patent [19]

Paciorek

[11] Patent Number: 5,267,849

[45] Date of Patent: Dec. 7, 1993

[54] SPARK IGNITING A FUEL BURNER

[75] Inventor: Raymond M. Paciorek, Darien, Ill.

[73] Assignee: Eaton Corporation, Cleveland, Ohio

[21] Appl. No.: 819,913

[22] Filed: Jan. 13, 1992

[51] Int. Cl.[5] ..... F23N 5/20

[52] U.S. Cl. ..... 431/6; 431/72; 431/254; 431/255; 126/39 E

[58] Field of Search ..... 431/6, 18, 72, 254, 431/264, 255, 266, 259, 262; 126/39 E

[56] References Cited

U.S. PATENT DOCUMENTS 3,358,474 12/1967 Liesse ..... 431/72 X
3,715,182 2/1973 Ward ..... 431/264
3,813,581 5/1974 Hewitt ..... 431/264 X
4,846,671 7/1989 Kwiatek ..... 431/264

*Primary Examiner*—Larry Jones
*Attorney, Agent, or Firm*—R. A. Johnston

[57] ABSTRACT

At least two sets of point-to-flat spark electrodes are connected for high voltage excitation from a pulse source such as individual secondary windings of a common transformer. Each secondary winding has one end connected to one of the pointed electrodes, with the other end of the winding commonly grounded with the flat electrode to provide common polarity to all pointed electrodes.

6 Claims, 3 Drawing Sheets

91CON443(AP)

91CON443(AP)

91CON443(AP)

SPARK IGNITING A FUEL BURNER

BACKGROUND OF THE INVENTION

The present invention relates to flame ignition of a gaseous fuel burner, particularly to ignition of plural fuel burners employed in a range.

Historically, plural range burners were ignited by a central standing pilot flame via flash tubes channelled from the standing pilot to the individual burners. However, in recent times, it has been desired to eliminate a standing pilot flame and to employ electric spark ignition of the individual burners. Typically, where it is desired to provide spark ignition of plural burners on a range, the spark igniter was centrally located and ignited individual burners via flash tubes connecting the central spark igniter with the individual burners. For safety reasons and for economies of manufacture, it has been desired to eliminate the use of flash tubes for plural burner ignition and most recently, ranges have utilized individual spark electrode sets disposed adjacent each burner.

Where individual spark electrodes have been provided adjacent each one of a plurality of burners, it has been common practice to provide the high voltage to a pair of the electrode sets by a common connection to a single secondary winding of a step-up transformer employed for generating the high voltage to create the spark.

Referring to FIG. 3, a typical prior art plural burner spark ignition system is illustrated where a pair of spark electrodes for igniting a pair of burners is indicated generally at 10 and 12 with each of the pairs having a pointed electrode 11,13 respectively, and a flat electrode 15,17 respectively. The pointed electrodes 11,13 are each attached to an opposite end of transformer secondary coil 14. The flat electrodes 15,17 are commonly grounded.

A second pair of burner ignition electrodes indicated generally at 16,18 is also typically employed for igniting a second pair of burners and each has a pointed electrode 19,21 respectively and a flat electrode 23,25 respectively disposed oppositely thereto. Each of the pointed electrodes 19,21 is connected to one opposite end of a second transformer secondary winding 20. The flat electrodes 23,25 are commonly grounded with electrodes 15,17 of the first pair 10,12. The secondary transformer windings 14,20 have a common transformer primary winding 22 which receives a pulse from the capacitive discharge circuit indicated generally at 24.

It will be seen from the prior art circuit arrangement of FIG. 3 that the current in the secondary windings flows in a common direction as indicated by the counter-clockwise arrows and the character "I". This prior art circuit arrangement results in a positive polarity at the pointed electrodes 11,19 and a negative polarity at the point of the electrodes 13,21. This type of spark discharge arrangement has been found to have the disadvantage that the flat electrodes 17,25 do not have a predominantly strongly positive point thereon and experience an unpredictable electric field pattern within the gap area and a random spark discharge in an erratic direction at times. Where the spark energy is reduced, such as by deterioration of the circuit components, or by low line voltage, such an arrangement may even prevent a spark from occurring at either burner electrode within the pair.

Thus it has been desired to find a way or means of providing a high energy spark discharge between a pair of electrodes adjacent a fuel burner utilizing the maximum commonality of transformer winding connections and to provide such a spark system with a reliable and repeatable high energy concentrated spark discharge for igniting gaseous fuel.

SUMMARY OF THE INVENTION

The present invention provides plural sets of spark electrodes, each connected to receive a high energy electrical pulse from a common pulse generation source such as, for example, a secondary winding of a step-up transformer for igniting plural gaseous fuel burners. Each pair of electrodes for a burner comprises a pointed electrode and a flat electrode with the pointed electrode receiving a positive electrical charge and the flat electrode connected for negative electrical polarity to concentrate the electrical charge for high intensity directed discharge across the electrodes to ignite the gaseous fuel emanating from the burner. In the presently preferred practice, a Sidac thyristor avalanches to discharge a capacitor across a common transformer primary coil winding to provide the high intensity voltage pulse on the secondary windings. In the illustrated embodiment, the transformer has four secondary windings, each having one end thereof connected to a separate pointed spark electrode with the opposite end of the secondary winding grounded to a common ground. The circuit arrangement of the present invention thus ensures positive polarity to the pointed electrode for providing reliable high intensity spark discharge to effect burner ignition.

DETAILED DESCRIPTION

Figure 1:
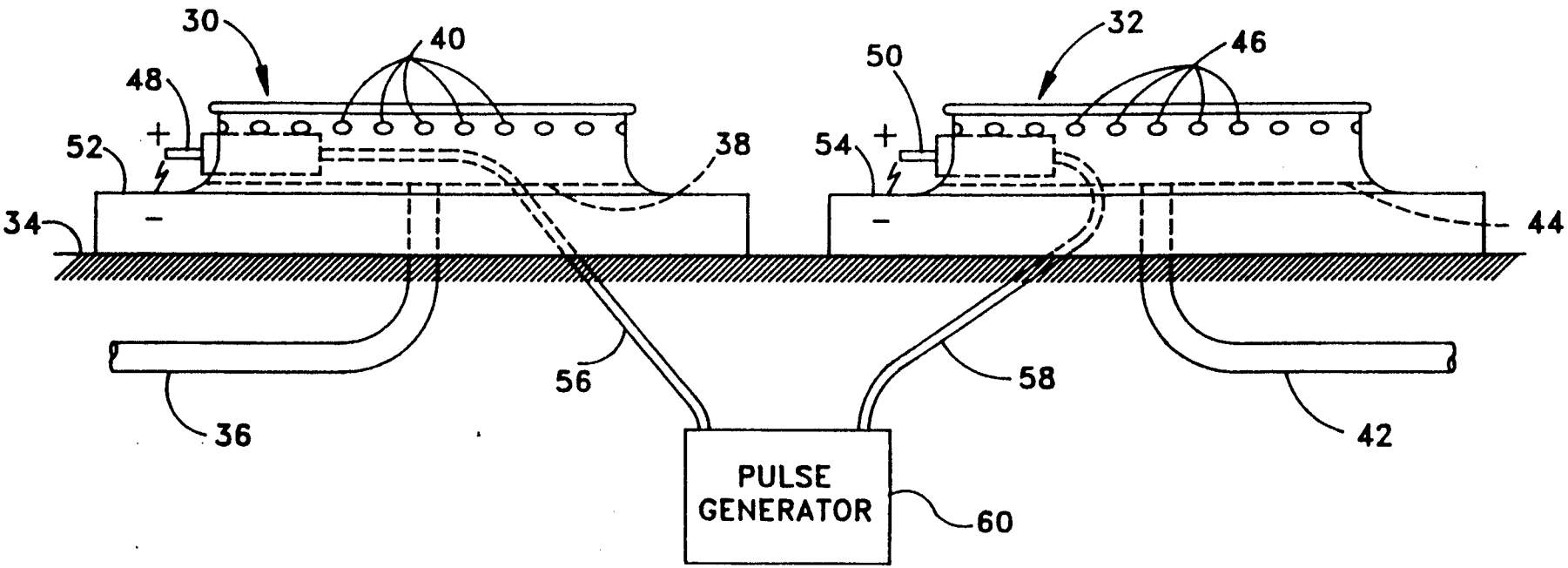
FIG. 1 is pictorial schematic of a pair of fuel burners disposed for spark ignition from a common pulse generator.

Referring to FIG. 1, a pair of fuel burners indicated generally at 30,32 are illustrated as mounted in convenient proximity to each other on a common structure 34 as, for example, a sheet metal cabinet or housing of a range. Burner 30 is supplied by a gaseous fuel pipe 36 attached to an internal manifold structure 38 which supplies the burner ports 40 disposed circumferentially about the burner in generally equally spaced arrangement. Similarly, a second fuel pipe 42 supplies manifold 44 which communicates with circumferentially spaced fuel ports 46 which are disposed about the burner 32. It will be understood that fuel pipes 36,42 are typically controlled by valves (not shown).

Each of the burners 30,32 has a generally pointed electrode 48,50, respectively attached thereto and each is disposed adjacent a flat electrode respectively denoted 52,54 between which spark discharge occurs. Pointed electrode 48 is connected via an electrical lead 56; and, pointed electrode 50 is connected via lead 58 to a common pulse generator 60 which will be described hereinafter in greater detail.

Figure 2:
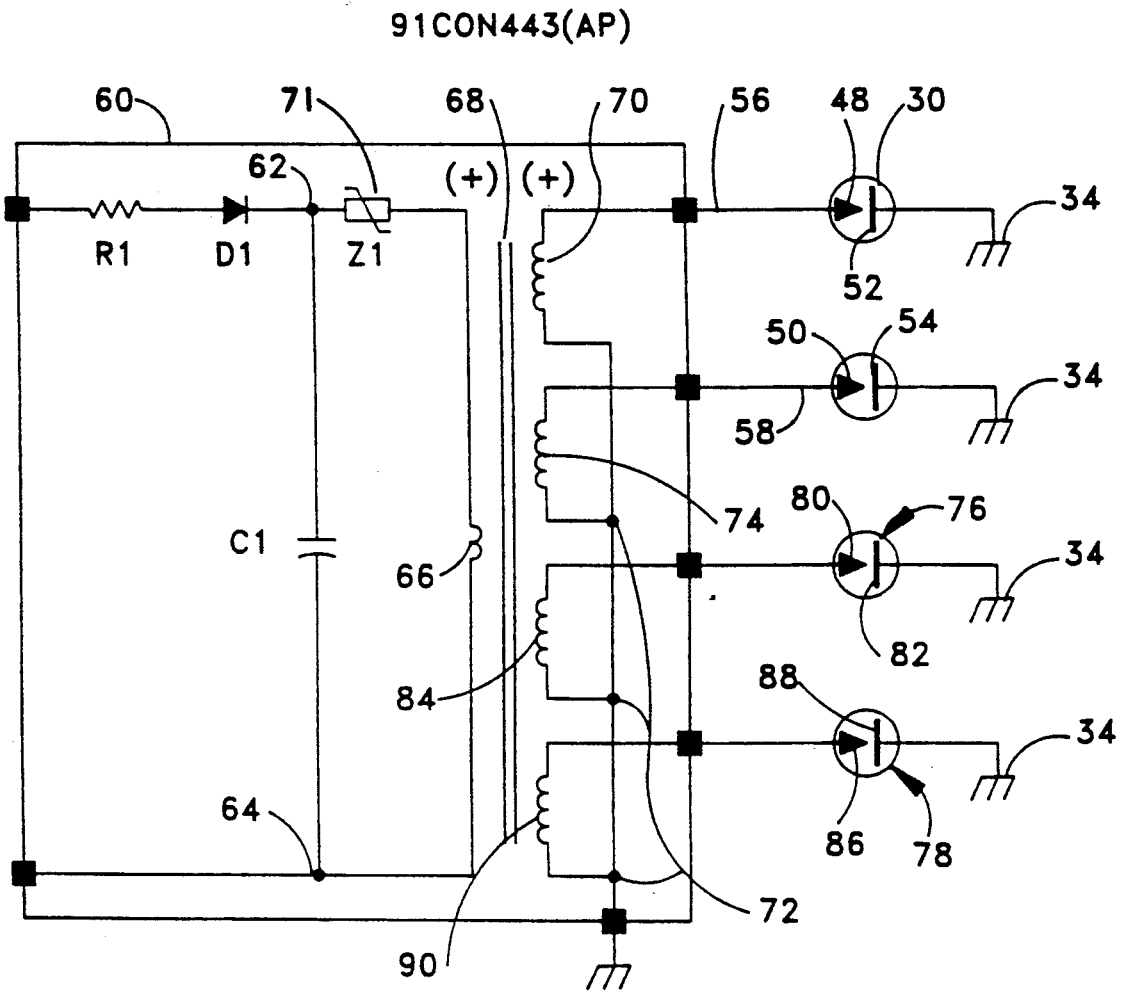
FIG. 2 is an electrical schematic of the pulse generator and electrode pairs for the system of FIG. 1; and, FIG. 3 is an electrical schematic similar to FIG. 2 of techniques employed in the prior art.
Figure 3:
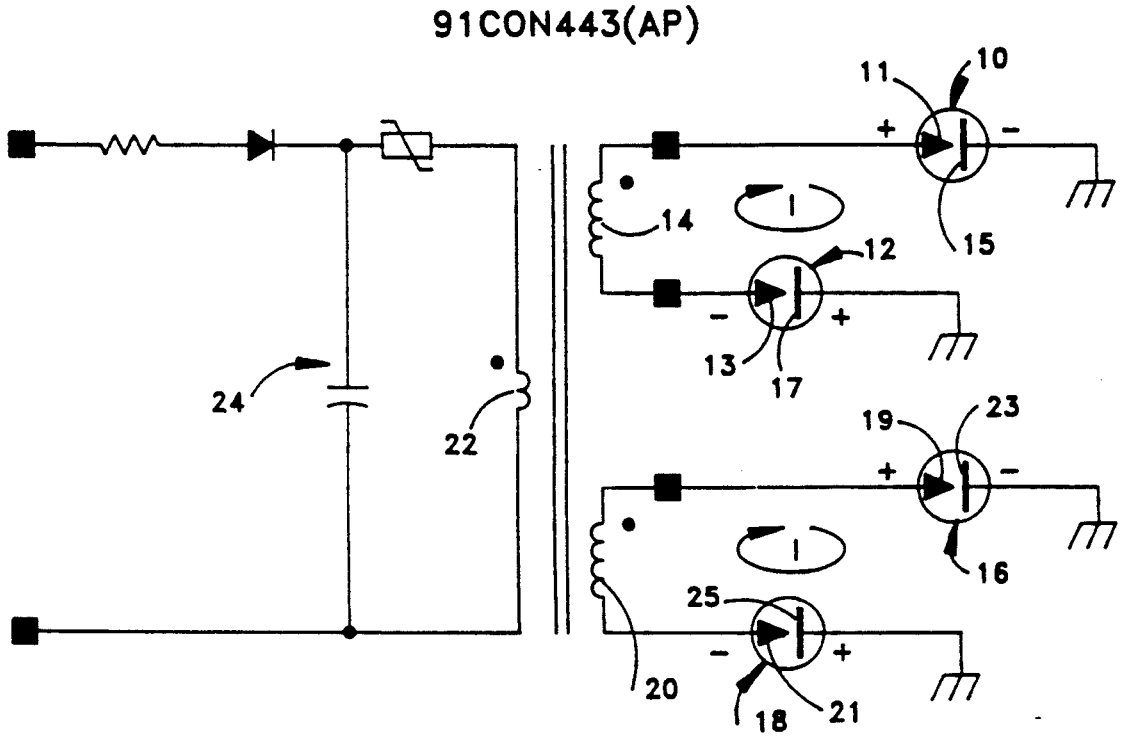
PRIOR ART FIG.3

Referring to FIG. 2, the pulse generator 60 preferably comprises an RC circuit including resistor R1 diode D1 connected to junction 62. A discharge capacitor Cl is connected to junction 62 and to junction 64 on the opposite side of a power line. Junction 62 is connected to the negative pole of a thyristor device 71, with the positive pole thereof connected to one end of a primary coil winding 66 of a step-up transformer 68.

The opposite end of winding 66 is connected to power line junction 64. Transformer 68 has a high turn count step-up secondary winding which has one end connected to pointed electrode lead 56 and the other end grounded through junction 72. A second transformer secondary winding 74 is provided and has one end thereof connected to pointed electrode lead 58 with the other end of coil 74 grounded through junction 72.

Upon charging of capacitor Cl to a sufficiently high level, device Z1 avalanches and conducts a positive current pulse through primary winding 66, thereby inducing the increased potential in the secondary coil 70,74 and a positive pulse of stepped up voltage is applied on electrodes 48,50 creating a spark discharge thereacross.

If desired, a second pair of fuel burners (not shown) may be provided; and, an appropriate pair of electrodes, indicated generally at 76,80 in FIG. 2, may be provided for each such burner for providing ignition discharge respectively to the additional unshown burners. Electrode pair 76 has a pointed positive electrode 80 disposed adjacent a flat negative grounded electrode. The positive electrode 80 is connected to one end of an additional transformer secondary winding 84 which has the opposite end thereof grounded through junction 72. Electrode pair 78 similarly has a positive electrode 86 with a pointed configuration disposed adjacent a flat electrode 88 which is grounded near structure 34. The pointed electrode 86 is connected to one end of an additional transformer secondary winding 90 which has the opposite end grounded through 72. Although the invention has been illustrated with a pulse generator 60 comprising an RC circuit discharging across the primary winding of a transformer to generate high voltage on a plural secondary winding, it will be understood that other suitable pulse generating techniques may be employed.

It will be understood that the circuit arrangement of FIG. 2 enables a plurality of fuel burners to be ignited from a single transformer having plural secondary windings with each winding connected to the pointed electrode of the pair disposed for igniting the respective fuel burner. The circuit of FIG. 2 provides a positive electrical charge on the pointed electrode to effect a concentrated and direct spark discharge between the pointed electrode and the closely spaced flat electrode which is grounded. The arrangement of the circuit of FIG. 2 thus provides concentrated high intensity reliable spark discharge for each electrode pair connected to spark ignite plural fuel burners from a common transformer.

Although the invention has hereinabove been described with respect to the illustrated embodiments, it will be understood that the invention is capable of modification and variation, and is limited only by the following claims:

I claim:

1. A method of spark igniting flame on a fuel burner comprising the steps of:

(a) disposing a point-to-flat set of spark electrodes adjacent each of a plurality of fuel burners;

(b) providing a relatively high voltage step-up transformer; and, (c) generating a pulse of desired polarity and applying said polarity commonly to each of the pointed electrodes of each point-to-flat set of electrodes and causing a spark to discharge therebetween.

2. The method defined in claim 1, wherein the step of generating a pulse includes the step of connecting each set of said electrodes to a separate secondary coil of a common transformer and applying said pulse to the primary coil thereof.

3. A fuel burner ignition system comprising:

(a) a plurality of spark electrode sets, each for individual burners, each set having (i) a generally flat-surface electrode, and (ii) a generally pointed electrode disposed a predetermined space from said flat electrode, (iii) means for commonly grounding said flat surface electrode;

(b) a relatively high voltage step-up transformer having (i) a primary winding, (ii) a plurality of secondary windings, each connected to one of said pointed electrodes and to said means for commonly grounding; and, (c) means for applying a positive polarity pulse to said primary winding of said transformer.

4. The system defined in claim 3, wherein said means applying said pulse includes a capacitor.

5. A method of spark igniting flame on a fuel burner comprising the steps of:

(a) disposing a point-to-flat set of spark electrodes adjacent each of a plurality of fuel burners;

(b) providing a relatively high voltage step-up transformer with a plurality of secondary windings and a single primary winding;

(c) connecting each of said point electrodes to one of said secondary windings;

(d) connecting the other end of each of said secondary windings and each of said flat electrodes to a common ground.

(e) applying only a positive supply voltage to the transformer primary winding and effecting a spark at each electrode set.

6. The method defined in claim 5, wherein said step of applying only a positive voltage includes the step of rectifying an alternating voltage.

* * * * *